US012044111B1

(12) United States Patent
Walker et al.

(10) Patent No.: US 12,044,111 B1
(45) **Date of Patent: *Jul. 23, 2024**

(54) SUBTERRANEAN CAPTURE OF PRODUCED GAS LOST IN GAS ENHANCED HYDROCARBON RECOVERY

(71) Applicant: Pioneer Natural Resources USA, Inc., Irving, TX (US)

(72) Inventors: Dustin L. Walker, Dallas, TX (US); Joshua W. Brownlow, Grapevine, TX (US); Ryan L. Pervier, Coppell, TX (US); Alexander Freeman, Flower Mound, TX (US); Andre Jean Nel, Keller, TX (US); Amirhossein Kamali, Irving, TX (US)

(73) Assignee: Pioneer Natural Resources USA, Inc., Irving, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,143

(22) Filed: Jan. 31, 2024

Related U.S. Application Data

(63) Continuation of application No. 18/523,195, filed on Nov. 29, 2023.

(51) Int. Cl.
*E21B 43/16* (2006.01)
*E21B 43/14* (2006.01)
*E21B 43/26* (2006.01)

(52) U.S. Cl.
CPC ..... *E21B 43/168* (2013.01); *E21B 43/14* (2013.01); *E21B 43/26* (2013.01)

(58) Field of Classification Search
CPC .. E21B 43/164; E21B 43/243; E21B 41/0064; E21B 43/30; E21B 43/24;
(Continued)

(56) References Cited

U.S. PATENT DOCUMENTS 3,794,114 A * 2/1974 Brandon ..... E21B 43/003 166/269
4,982,786 A 1/1991 Jennings, Jr.
(Continued)

FOREIGN PATENT DOCUMENTS

CA 2762498 A1 * 11/2012 ..... E21B 43/24
CA 2833068 6/2014
(Continued)

OTHER PUBLICATIONS

Translation of CN 108343421. (Year: 2018).*
(Continued)

*Primary Examiner* — Zakiya W Bates
(74) *Attorney, Agent, or Firm* — Scheef & Stone, LLP; Keith C. Rawlins

(57) ABSTRACT

Subterranean gas capture wellbores are used to capture lost produced gas. Produced gas can be injected into a subterranean for gas enhanced hydrocarbon recovery and rise in the subterranean formation toward a production wellbore. A first portion is effective for enhanced hydrocarbon recovery and a second portion rises past the production wellbore to become the lost produced gas that is converted to captured produced gas in the subterranean gas capture wellbore. The captured produced gas can then flow in the subterranean gas capture wellbore to the surface for recovery.

20 Claims, 7 Drawing Sheets

(58) Field of Classification Search
CPC .... E21B 43/168; E21B 43/305; E21B 43/166; E21B 43/40; E21B 43/385
See application file for complete search history.

(56) References Cited

U.S. PATENT DOCUMENTS

| | | | | |
|---|---|---|---|---|
| 5,273,111 | A | 12/1993 | Brannan et al. | |
| 7,073,577 | B2 | 7/2006 | Yu | |
| 8,770,281 | B2 | 7/2014 | Arthur et al. | |
| 8,833,454 | B2 | 9/2014 | Duong | |
| 8,925,632 | B2 | 1/2015 | Bunio et al. | |
| 9,562,422 | B2 | 2/2017 | Sharma et al. | |
| 9,732,594 | B2 * | 8/2017 | Gardes | E21B 43/385 |
| 10,815,761 | B2 | 10/2020 | Arthur et al. | |
| 11,680,466 | B2 | 6/2023 | Vinegar et al. | |
| 11,697,983 | B2 | 7/2023 | AlKhateeb et al. | |
| 2015/0034313 | A1 * | 2/2015 | Gittins | E21B 43/243 166/261 |
| 2020/0018144 | A1 | 1/2020 | Haney | |
| 2022/0228467 | A1 | 7/2022 | Procinsky | |

FOREIGN PATENT DOCUMENTS

| | | | | |
|---|---|---|---|---|
| CA | 3050701 | | 11/2018 | |
| CA | 3014378 | | 2/2019 | |
| CA | 3014397 | | 2/2019 | |
| CA | 3014879 | | 2/2019 | |
| CA | 3113483 | | 6/2019 | |
| CA | 3022711 | | 4/2020 | |
| WO | WO-2009098597 | A2 * | 8/2009 | E21B 41/0064 |

OTHER PUBLICATIONS

Liu et al., "Numerical simulation and optimization of injection rates and wells placement for carbon dioxide enhanced gas recovery using a genetic algorithm", Journal of Cleaner Production,280(2), 124512, Jan. 20, 2021, https://doi.org/10.1016/j.jclepro.2020.124512, 7 pages.

Luo et al., "Numerical investigation of the influence of verticalpermeability heterogeneity in stratified formation and ofinjection/production well perforation placement on CO geological storage with enhanced CH4 recovery", Applied Energy, 102, 1314-1323, Feb. 2013, ,https://www.sciencedirect.com/science/article/abs/pii/S030626191200520X?via%3Dihub, 5 pages.

Louk et al., "Monitoring CO2 storage and enhanced gas recovery in unconventional shale reservoirs: Results from the Morgan County, Tennessee injection test," Journal of Natural Gas Science and Engineering, 45, 11-25, https://www.sciencedirect.com/science/article/pii/S1875510017301427, May 30, 2017, 19 pages.

Mao et al., "Numerical simulation on gas production from inclined layered methane hydrate reservoirs in the Nankai Trough: A case study," Energy Reports, vol. 7, Nov. 2021, 8608-8623, https://www.sciencedirect.com/science/article/pii/S2352484721002018?via%3Dihub, 31 pages.

* cited by examiner

SUBTERRANEAN CAPTURE OF PRODUCED GAS LOST IN GAS ENHANCED HYDROCARBON RECOVERY

FIELD OF THE DISCLOSURE

The present disclosure generally relates to the enhanced hydrocarbon recovery, and more particularly to enhanced hydrocarbon recovery by gas injection.

BACKGROUND

In hydrocarbon production, a wellbore can be formed into hydrocarbon reservoir contained in a subterranean formation. Hydrocarbon recovery, such as for natural gas or crude oil, can occur because naturally-existing formation pressures move the hydrocarbons from the reservoir into and through the wellbore, and to the surface of the wellsite. Over time, production rates subside, and secondary and then enhanced hydrocarbon recovery techniques can be utilized to increase hydrocarbon productions rates from the reservoir.

One technique for enhanced hydrocarbon recovery is gas injection. In gas injection, a gas such carbon dioxide, nitrogen, or natural gas is injected into the reservoir via the wellbore or into or near the reservoir via an injection wellbore formed in the subterranean formation that is fluidly connected to the same reservoir as the wellbore that produces hydrocarbons. The injected gas improves hydrocarbon displacement from the reservoir and into the wellbore that produced hydrocarbons.

SUMMARY

Disclosed is a process that includes injecting a produced gas into a subterranean formation via a horizontal portion of a first wellbore that extends into the subterranean formation; recovering a hydrocarbon-containing fluid containing a first portion of the injected produced gas from a horizontal portion of a second wellbore that extends into the subterranean formation, wherein a depth of the horizontal portion of the first wellbore in the subterranean formation is greater than a depth of the horizontal portion of the second wellbore in the subterranean formation; and recovering a second portion of the injected produced gas from a gas capture wellbore that extends into the subterranean formation, wherein the gas capture wellbore has a horizontal portion having a gas capture depth that is less than a depth of the horizontal portion of the second wellbore.

Disclosed is another process that includes converting a non-producing zone of a subterranean formation into a gas capture zone by forming a gas capture wellbore in the non-producing zone, wherein the gas capture wellbore has a horizontal portion that is stacked above a horizontal portion of a production wellbore that extends into a producing zone of the subterranean formation and stacked above a horizontal portion of an injection wellbore that extends into or below the producing zone of the subterranean formation.

Disclosed is a subterranean formation having an injection wellbore including multiple horizontal portions extending into the subterranean formation; a production wellbore including multiple horizontal portions extending into the subterranean formation above the multiple horizontal portions of the injection wellbore; and a gas capture wellbore including one or more horizontal portions extending into the subterranean formation above the multiple horizontal portions of the injection wellbore and above the multiple horizontal portions of the production wellbore.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

"Producing zone" refers to a portion of a subterranean formation that contains hydrocarbons that are recoverable through primary hydrocarbon recovery techniques (e.g., drilling), secondary hydrocarbon recovery techniques (e.g., fracking, also referred to as fracturing), and enhanced hydrocarbon recovery techniques (e.g., chemical injection, thermal treatment, or gas injection).

"Gas capture zone" refers to a portion of the subterranean formation that is located above the producing zone. A gas capture zone in some cases may not contain hydrocarbons. In other cases, a gas capture zone may contain hydrocarbons, however, the hydrocarbons are not recoverable through primary, secondary, and enhanced hydrocarbon recovery techniques. In yet other cases, a gas capture zone may contain hydrocarbons, but the hydrocarbons are not present in an amount that is economical to form wellbores for the purposes of the production of hydrocarbons therefrom.

"Produced gas" refers to a gas that is recovered from a well stream that is produced from a wellbore. Produced gas can include, for example, light hydrocarbons that remain in gas phase when injected into a subterranean formation, such as methane, ethane, propane, or combinations thereof.

"Vertical portion" refers to a portion of a wellbore that is more vertically oriented than a horizontal portion of the same wellbore. A vertical portion may be exactly vertical or may extend at an angle with respect to vertical that is +/−89°.

"Horizontal portion" refers to a portion of a wellbore that is more horizontally oriented than a vertical portion of the same wellbore. A horizontal portion may be exactly horizontal or may extend at an angle with respect to horizontal that is +/−89°.

"Hydrocarbon-containing fluid" refers to a fluid that is produced or otherwise extracted from a subterranean formation via a wellbore that is formed in the subterranean formation. In aspects, the hydrocarbon-containing fluid is produced or otherwise extracted from a subsea subterranean formation.

As used herein, any recited ranges of values contemplate all values within the range including the end points of the range, and are to be construed as support for claims reciting any sub-ranges having endpoints which are real number values within the recited range. By way of example, a disclosure in this specification of a range of from 10 to 15 shall be considered to support claims to values of 10, 11, 12, 13, 14, and 15, and to any of the following ranges: 10-11, 10-12, 10-13, 10-14, 10-15, 11-12, 11-13, 11-14, 11-15, 12-13; 12-14, 12-15, 13-14, 13-15, and 14-15.

Figure 1:
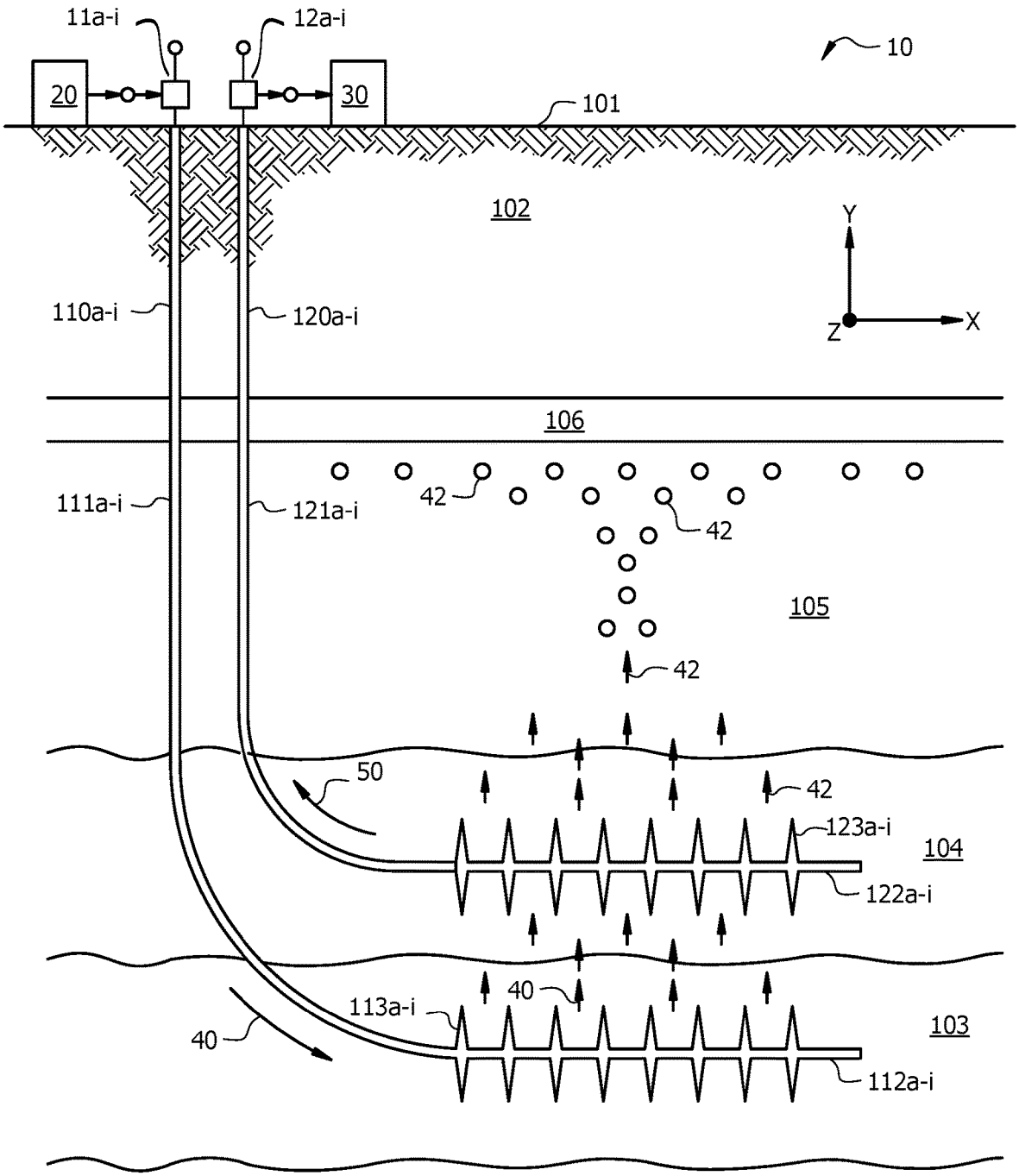
FIG. 1 illustrates a cross-sectional view of a wellbore environment having wellbores formed in producing zones of a subterranean formation, viewing an X-Y plane of the subterranean formation with the Z-axis pointing into the page.

FIG. 1 illustrates a cross-sectional view of a wellbore environment 10 having wellbores 110*a-i* and 120*a-i* formed in producing zones 103 and 104 of a subterranean formation 102, viewing an X-Y plane of the subterranean formation 102 with the Z-axis pointing into the page.

The subterranean formation 102 can include one or more producing zones, and in FIG. 1, two producing zones 103 and 104 are shown. The producing zones 103 and 104 can be surrounded by zones that are not targeted for hydrocarbon production, and thus have no wellbores drilled therein, such as zone 105 of the subterranean formation 102. Producing zone 103 is generally below producing zone 104, and both producing zones 103 and 104 are below zone 105, which is not targeted for production because no producing wellbores are formed in the zone 105 of the subterranean formation 102. A subterranean formation 102 can include other producing zones, and two producing zones 103 and 104 are illustrated for descriptive purposes. In aspects, the producing zones 103 and 104 can be referred to as layers of the same producing zone.

Wellbores 110*a-i* and 120*a-i* are formed in the subterranean formation 102 for purposes of recovering hydrocarbons from the producing zones 103 and 104. The designation "a-i" means that there is a separate occurrence of element being described for every letter in the series. For example, when used in reference to wellbores 110*a-i*, it is intended to mean that there are nine (9) wellbores 110*a*, 110*b*, 110*c*, 110*d*, 110*e*, 110*f*, 110*g*, 110*h*, and 110*i* formed in the subterranean formation 102, and when used in reference to wellbores 120*a-l*, it is intended to mean that there are nine (9) wellbores 120*a*, 120*b*, 120*c*, 120*d*, 120*e*, 120*f*, 120*g*, 120*h*, and 120*i* formed in the subterranean formation 102. While nine wellbores 110*a-i* are illustrated in producing zone 103, it is contemplated that more or fewer wellbores can be formed in the producing zone 104. Likewise, while nine wellbores 120*a-i* are illustrated in producing zone 104, it is contemplated that more or fewer wellbores can be formed in the producing zone 104.

Each of the wellbores 110*a-i* and 120*a-i* has a vertical portion 111*a-i* and 121*a-i* and a horizontal portion 112*a-i* and 122*a-i*. The numbering herein intends that, for example, a wellbore 110*a* has vertical portion 111*a* and horizontal portion 112*a*, wellbore 120*a* has vertical portion 121*a* and horizontal portion 122*a*, and so on. While not drawn to scale, wellbores 110*a-i* and 120*a-i* can extend to a depth of greater than 10,000 ft (3048 m) below the surface 101 of the Earth.

Wellbores 110*a-i* and 120*a-i* can be referred to as unconventional wellbores because of the presence of the horizontal portion 112*a-i* and 122*a-i* of each wellbore 110*a-i* and 120*a-i*. Horizontal portions 112*a-i* of wellbores 110*a-i* are formed in a producing zone 103 of the subterranean formation 102, and horizontal portions 122*a-i* of the wellbores 120*a-i* are formed in a producing zone 104 of the subterranean formation 102.

Figure 2:
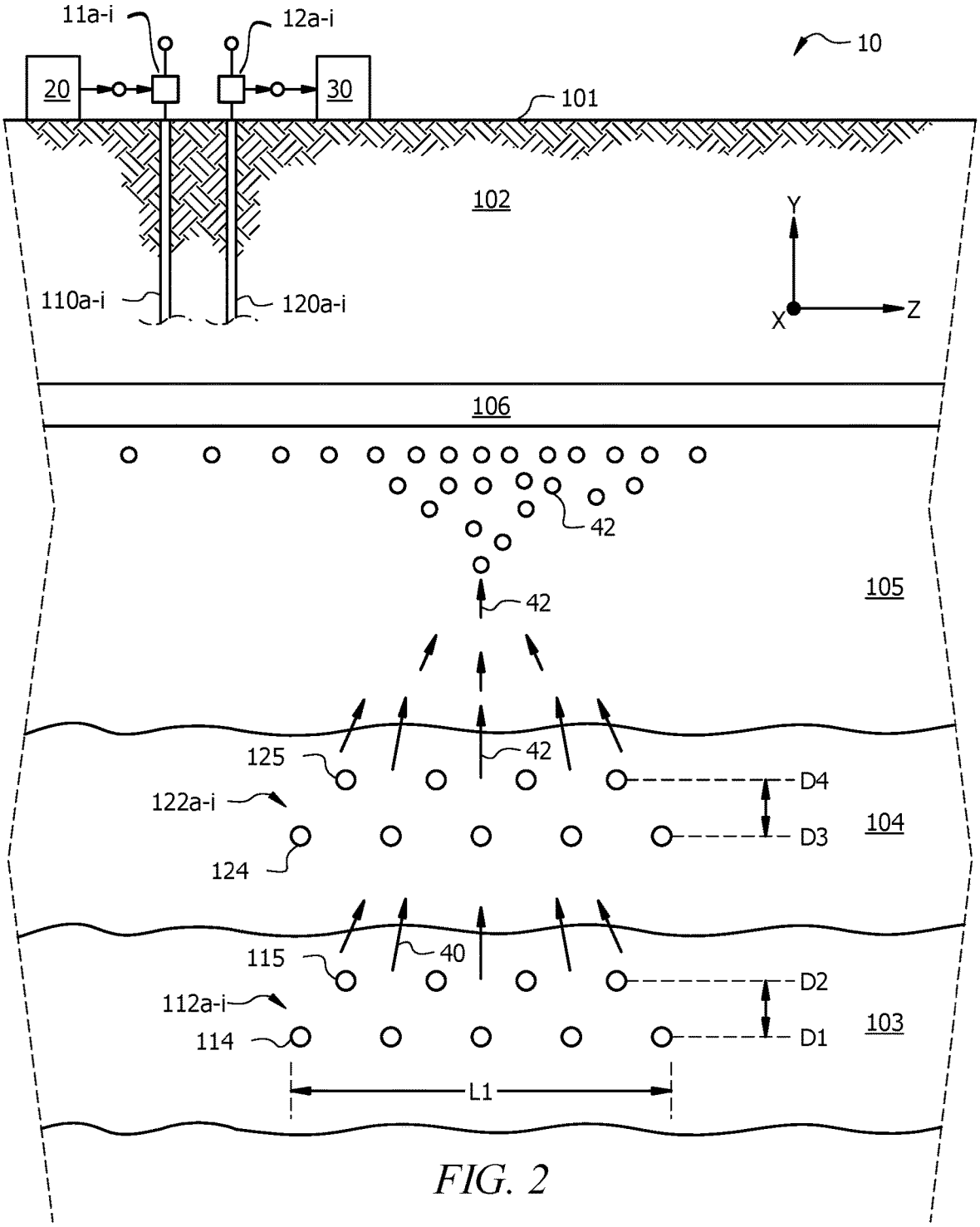
FIG. 2 illustrates another cross-sectional view of the wellbore environment of FIG. 1, viewing a Z-Y plane of the subterranean formation with the X-axis pointing into the page.

In aspects, the horizontal portions 112*a-i* of the wellbores 110*a-i* can be laterally spaced from one another, vertically spaced from one another (stacked), or both laterally and vertically spaced from one another. An example of an arrangement of horizontal portions 112*a-i* for the first set of wellbore 110*a-i* is illustrated in FIG. 2 and described herein.

Similarly, in aspects, the horizontal portions 122*a-i* of the wellbores 120*a-i* can be laterally spaced from one another, vertically spaced from one another (stacked), or both laterally and vertically spaced from one another. An example of an arrangement of horizontal portions 122*a-i* for the second set of wellbores 120*a-i* is illustrated in FIG. 2 and described herein.

The horizontal portion 112*a-i* of the first set of wellbores 110*a-i* are formed at a vertical depth below the surface 101 of the Earth that is greater than the vertical depth below the surface 101 of the Earth at which the horizontal portions 122*a-l* of the second set of wellbores 120*a-i* are formed. The first set of wellbores 110*a-i* can be referred to as the "lower wellbores" relative to the second set of wellbores 120*a-i* since the horizontal portion(s) 112*a-i* of the first set of wellbores 110*a-i* are at greater depth than the horizontal portions 122*a-i* of the second set of wellbores 120*a-i*. Additionally or alternatively, the first set of wellbores 110*a-i* can be referred to as the "lowest wellbore" relative to the second set of wellbores 120*a-i* and any other wellbore formed in the producing zones 103 and 104 since the horizontal portions 112*a-i* of the first set of wellbores 110*a-i* are at greater depth than the horizontal portions 122*a-i* of the second set of wellbores 120*a-i*, and because the horizontal portions 112*a-l* of the first set of wellbores 110*a-i* are at a greater depth than any other horizontal portions of any other wellbores that may be formed in the producing zones 103 and 104. The second set of wellbores 120*a-i* can be referred to as the upper wellbores relative to the first set of wellbores 110*a-i* since the horizontal portions 122*a-i* of the second set of wellbores 120*a-i* are at a lesser depth than the horizontal portions 112*a-i* of the first set of wellbores 110*a-i*. In some aspects, the horizontal portions 122*a-i* of the second set of wellbores 120*a-i* are above the horizontal portions 112*a-i* of the first set of wellbores 110*a-i*, and this can be referred as a "stacked" arrangement of the first set of wellbores 110*a-i* and the second set of wellbores 120*a-i*.

The horizontal portions 112*a-i* of the first set of wellbores 110*a-i* can include fractures 113*a-i* that are formed in the producing zone 103 of the subterranean formation 102. The horizontal portions 122*a-i* of the second set of wellbores 120*a-i* can include fractures 123*a-i* that are formed in the producing zone 104 of the subterranean formation 102. The fractures 113*a-i* and 123*a-i* can be formed according to any technique for fracturing a formation for hydrocarbon production. There can be fractures corresponding to each wellbore, e.g., fractures 113*a* corresponding with wellbore 110*a*; additionally or alternatively, fractures can exist naturally in the subterranean formation 102; additional or alternatively, the fractures from one wellbore can extend next to another wellbore.

During production of hydrocarbons that takes place after fractures 113*a-i* and 123*a-i* are produced (this production stage can be referred to as secondary hydrocarbon recovery), both sets of wellbores 110*a-i* and 120*a-i* can produce hydrocarbons that are recovered at the surface 101. The hydrocarbons can flow in a hydrocarbon-containing fluid from the producing zones 103 and 104 and into the wellbores 110*a-i* and 120*a-i*. The hydrocarbons can flow through the wellbores 110*a-i* and 120*a-i* to wellheads 11*a-i* and 12*a-i*. The designation "a-i" for wellheads is intended to mean that there is one wellhead for each wellbore. For example, wellhead 11*a* is connected to wellbore 110*a*, wellhead 12*a* is connected to wellbores 120*a*, and so on. The hydrocarbon-containing fluid can flow through the wellheads 11*a-i* and 12*a-i*, through a production line that is fluidly coupled to each wellhead 11*a-l* and 12*a-i*, and to the separation equipment 30. The hydrocarbon-containing fluid during this stage of production (which is contemplated to be a production stage after any flowback is produced due to fracking) can include, without limitation, crude oil, natural gases, condensates, water, proppant (e.g., sand), or combinations thereof. A pressure of the hydrocarbon-containing fluid can be in a range of from about 10,000 psia (68.94 MPa) to 15,000 psia (103.4 MPa), for example.

The hydrocarbons can flow in the hydrocarbon-containing fluid upward through the wellbores 110*a-i* and 120*a-i*, and to the respective wellheads 11*a-i* and 12*a-i* at the surface 101 of the Earth. Each wellhead 11*a-i* and 12*a-i* can include any equipment known in the art for hydrocarbon production, such as a valve tree. A production line (e.g., comprising one or more pipe segments, valves, control instrumentation, etc.) can be fluidly coupled to the wellheads 11*a-i* or 12*a-i* and to separation equipment 30 that is located also at the surface 101.

The separation equipment 30 is configured to separate and recover hydrocarbons contained in the hydrocarbon-containing fluid (e.g., crude oil, natural gas, condensates) from other components of the hydrocarbon-containing fluid (e.g., solids, non-hydrocarbon liquids, and non-hydrocarbon gaseous components such as acid gases).

For example, in embodiments where the hydrocarbon-containing fluid contains crude oil, natural gases, water (e.g., contained in a brine), and proppant (e.g., sand), the separation equipment 30 can be embodied as one or more vessels and/or devices that separate the sand, natural gases, and water from the crude oil, for recovery of the crude oil in a crude oil stream. For example, the hydrocarbon-containing fluid can flow to a first separator of the separation equipment 30 for removal of the natural gases from the hydrocarbon-containing fluid to form a first steam having the remaining liquid and solid phases (e.g., water, crude oil, and sand). The first stream can then flow to a second separator (comprising one or more vessels) for separation of the first stream into a second stream containing the water, a third stream containing the sand, and a fourth stream containing the crude oil and the composition. The fourth stream can then flow to a storage vessel for storage. In another example, the hydrocarbon-containing fluid can flow to a multiphase separator where the hydrocarbon-containing stream is separated into a first stream containing the natural gases, a second stream containing the water, and a third stream containing the crude oil, where the sand settles to the bottom of the multiphase separator.

In another example, in embodiments where the hydrocarbon-containing fluid contains natural gases, acid gases and solid particulates (e.g., sand), the separation equipment 30 can be embodied as one or more vessels and/or devices that separate the sand from the natural gases and acid gases. For example, the hydrocarbon-containing fluid can flow to a first separator of the separation equipment 30 for removal of the natural gases and acid gases from the sand. The natural gases and acid gases can then flow in a stream to a second separator (comprising one or more vessels) for separation of the natural gases from the acid gases.

After secondary hydrocarbon recovery rates fall to a value that is uneconomical or undesirable, enhanced hydrocarbon recovery techniques can be implemented. FIG. 1 illustrates the use of a technique of gas enhanced hydrocarbon recovery. In gas enhanced hydrocarbon recovery, production from the first set of wellbores 110*a-i* (the lowest wellbore) can be stopped, and the first set of wellbores 110*a-i* can be fluidly disconnected from the separation equipment 30. The first set of wellbores 110*a-i* can then be fluidly connected to the gas injection equipment 20. The first set of wellbores 110*a-i* (the lowest wellbore) is then converted into an injection wellbore. The gas injection equipment 20 can be configured to inject a produced gas 40 into the first set of wellbores 110*a-i*, each of the wellbores 110*a-i* now functioning as an injection wellbore, and collectively, the wellbores 110*a-i* are the lowest wellbores of any wellbores formed in the producing zones 103 and 104. Gas injection equipment 20 can be fluidly connected to each of the wellheads 11*a-i*, either directly or indirectly via a valve tree by an injection line. Injection equipment 20, by example, can include one or more vessels for storing the produced gas and one or more gas pumps (e.g., also referred to as blowers) or compressors (e.g., depending on an injection pressure needed) fluidly connected to the one or more storage vessels for introducing the produced gas into the wellbores 110*a-i*, and subsequently into the producing zone 103 of the subterranean formation 102. In aspects, the produced gas 40 is obtained from the separation equipment 30, e.g., a light gas stream of the separation equipment 30 can be fluidly connected to one or more vessels or pumps/compressors of the injection equipment 20 for transfer of the recovered light hydrocarbons to the injection equipment 20 for use as produced gas 40 that is injected into the subterranean formation 102 via wellbores 110*a-i*.

FIG. 1 illustrates, via upward pointing arrows, that the injected produced gas 40 can rise upward through the subterranean formation 102 from the horizontal portions 112*a-i* of the wellbores 110*a-i* due to the lower density of the produced gas compared to the rock, minerals, water, brine, or other hydrocarbons that are contained in the subterranean formation 102. Some of the produced gas 40 has the effect of increasing hydrocarbon recovery, urging hydrocarbons in the producing zones 103 and 104 of the subterranean formation 102 toward the horizontal portion 122*a-i* of the second set of wellbores 120*a-i*. A hydrocarbon-containing fluid 50 that includes some of the produced gas 40 can flow through the second set of wellbores 120*a-i* to the wellheads 12*a-i* at the surface 101 (and to the separation equipment 30).

It has been found that with this enhanced recovery technique, some of the produced gas 42 is lost into the subterranean formation 102 at locations in the subterranean formation 102 that are above the wellbores 110*a-i* and wellbores 120*a-i*. For example, some of the produced gas 42 continues to rise above the second set of wellbores 120*a-i*, and is lost into zone 105 of the subterranean formation 102. In some aspects, the lost produced gas 42 can become trapped under an impermeable zone 106 of the subterranean formation 102, can diffuse into a non-producing zone 105 where there are no production wellbores, can diffuse into a non-producing zone 105 to an extent that no significant amounts of produced gas are recoverable from any particular location in the subterranean formation 102, or combinations thereof.

FIG. 2 illustrates another cross-sectional view of the wellbore environment 10 of FIG. 1, viewing a Z-Y plane of the subterranean formation 102 with the X-axis pointing into the page. It can be seen that there are nine (9) horizontal portions 112*a-i* and nine (9) horizontal portions 122*a-i*. The illustration of nine (9) is exemplary only, and the number of horizontal portions 112*a-i* and 122*a-i* can be greater or fewer than nine. Additionally or alternatively, the number of horizontal portions 112*a-i* can be greater than, equal, or less than the number of horizontal portions 122*a-i*.

The arrangement of the horizontal portions 112*a-i* of wellbores 110*a-i* and the horizontal portions 122*a-i* of the wellbores 120*a-i* shown in FIG. 2 can be referred to as a "gun barrel" arrangement of the horizontal portions 112*a-i* of the wellbores 110*a-i* and of the horizontal portions 112*a-i* of the 120*a-i*. It can be noticed that some of the vertical portions 111*a-i* and 121*a-i* of the wellbores 110*a-i* and 120*a-i* that are drawn in FIG. 1 are not drawn in FIG. 2 for clarity of viewing the horizontal portions 112*a-i* and 122*a-i* of the wellbores 110*a-i* and 120*a-i* via the Z-Y plane of the subterranean formation 102. Also, the vertical portions 111*a-i* and 121*a-i*, along with wellheads 11*a-i* and 12*a-i*, in practice, may be more centered relative to the center of the horizontal portions 112*a-i* of the first set of the wellbores 110*a-i* and/or the center of the horizontal portions 122*a-i* of the second set of the wellbores 120*a-i*. Further, other arrangements of horizontal portions 112*a-i* and horizontal portions 122*a-i* are contemplated and not limited by the arrangements illustrated. Moreover, the horizontal portions 112*a-i* can be in a first arrangement that is different than second arrangement of the horizontal portions 122*a-i*. Further, the arrangement can be influenced by 1) naturally occurring fractures coinciding with the wellbores 110*a-i* and 120*a-i* in the area promote gas recovery 2) low pressure, or depleted zones coinciding with the wellbores 110*a-i* and 120*a-i* that can promote gas recovery, or 3) other geologic or rock/fluid characteristics which would promote capturing the injected gas 40.

In FIG. 2, the horizontal portions 112*a-i* are formed such that a first set 114 of horizontal portions 112*a-i* is at depth D1 and a second set 115 of horizontal portions 112*a-i* is at a depth D2, where depth D1 is greater than depth D2. Depths D1 and D2 are measured from a center of a given horizontal portion 112*a-i* of the wellbores 110*a-i*. Moreover, the first set 114 are horizontally equally-spaced relative to one another, and the second set 115 are horizontally equally-spaced relative to one another. The end-to-end length L1 of the horizontal portions 112*a-i* can be seen in the Z-direction of the view shown in FIG. 2.

Likewise in FIG. 2, the horizontal portions 122*a-i* are formed such that a first set 124 of the horizontal portions 122*a-i* is at depth D3 and a second set 125 of the horizontal portions 122*a-i* is at a depth D4, where depth D3 is greater than depth D4. Depths D3 and D4 are measured from a center of a given horizontal portion 122*a-i* of the wellbores 120*a-i*. Depths D1 and D2 are generally greater in value (deeper) than depths D3 and D4. Moreover, the first set 124 are horizontally equally-spaced relative to one another, and the second set 125 are horizontally equally-spaced relative to one another. The end-to-end length L1 of the horizontal portions 122*a-i* can be seen in the Z-direction of the view shown in FIG. 2.

The horizontal portions 122*a-i* of the wellbores 120*a-i* are stacked relative to the horizontal portions 112*a-i* of the wellbores 110*a-i*. All of the horizontal portions 112*a-i* are contained in the producing zone 103, and all of the horizontal portions 122*a-i* are contained in the producing zone 104.

Similar to the wellbore environment 10 described for FIG. 1, the wellbore environment 10 in FIG. 2 illustrates the movement of injected produced gas in a gas enhanced hydrocarbon recovery technique. Via illustration of upward pointing arrows, the injected produced gas 40 can rise upward through the subterranean formation 102 from the horizontal portions 112*a-i* of the wellbores 110*a-i* from which the produced gas 40 is injected, due to the lower density of the produced gas compared to the rock, minerals, water, brine, or other hydrocarbons that are contained in the subterranean formation 102. Some of the produced gas 40 has the effect of increasing hydrocarbon recovery, urging hydrocarbons in the producing zones 103 and 104 of the subterranean formation 102 toward the horizontal portions 122*a-i* of the second set of wellbores 120*a-i* that are stacked relative to the horizontal portions 112*a-i* of the first set of wellbores 110*a-i* (the injection wellbore in the gas enhanced recovery technique). A hydrocarbon-containing fluid 50 that includes some of the produced gas 40 can flow through the second set of wellbores 120*a-i* to the wellheads 12*a-i* at the surface 101 (and to the separation equipment 30).

FIG. 2 illustrates that some of the produced gas 42 is lost into zone 105 of the subterranean formation 102, at locations in the subterranean formation 102 that are above the wellbores 110*a-i* and wellbores 120*a-i*. Particularly, the lost produced gas 42 is trapped under an impermeable zone 106 of the subterranean formation 102 and has also diffused laterally in the Z-directions into the non-producing zone 105 where there are no production wellbores.

In aspects, an amount of the injected produced gas 40 that is produced in the hydrocarbon-containing fluid 50 can be equal to or less than 25 vol %, e.g., in a range of from 25 vol % to 75 vol %, based on a total volume of the injected produced gas 40. By some estimates an amount of the injected produced gas 40 that becomes lost produced gas 42 can be in a range of from 25 vol % to 75 vol % based on a total volume of injected produced gas 40.

The disclosed techniques discussed with reference to FIG. 3 and FIGS. 4A to 4D provide subterranean gas capture wellbores for capture of the lost produced gas 42 that would otherwise be lost into the subterranean formation 102 at locations that are above the enhanced production wellbores 120*a-i*.

Figure 3:
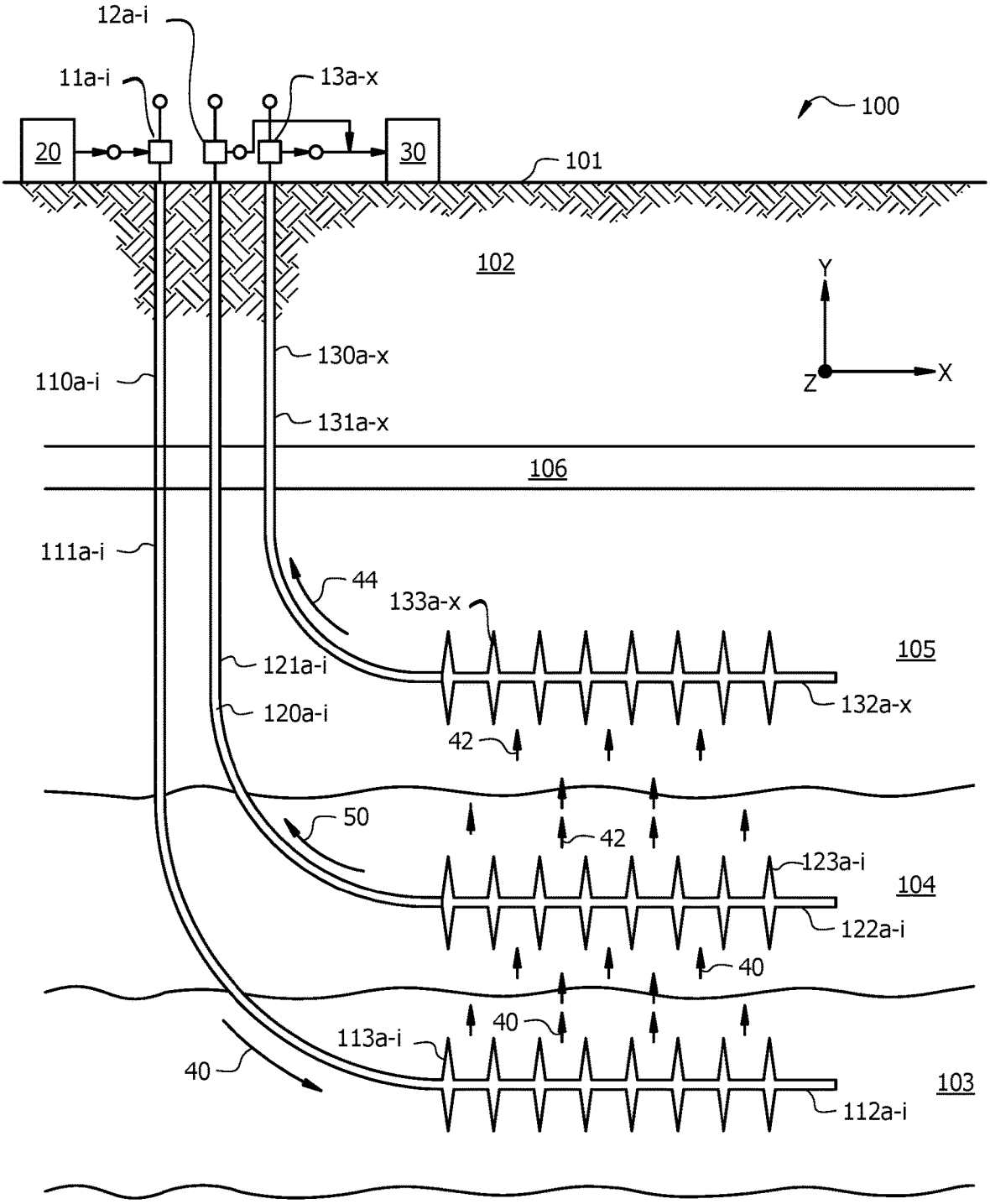
FIG. 3 illustrates a cross-sectional view of a wellbore environment having wellbores formed in the producing zones of the subterranean formation and at least one wellbore formed in a gas capture zone of the subterranean formation, viewing an X-Y plane of the subterranean formation with the Z-axis pointing into the page.

FIG. 3 illustrates a cross-sectional view of a wellbore environment 100 having wellbores 110*a-i* and 120*a-i* formed in the producing zones 103 and 104 of the subterranean formation 102 and one or more subterranean gas capture wellbores 130*a-x* formed in a gas capture zone 105 of the subterranean formation 102, viewing an X-Y plane of the subterranean formation 102 with the Z-axis pointing into the page.

The wellbore environment 100 in FIG. 3 includes everything in the wellbore environment in FIG. 1 and FIG. 2, including but not limited to, the subterranean formation 102 having zones 103, 104, 105, and 106, the first set of wellbores 110*a-i* having vertical portions 111*a-i* and horizontal portions 112*a-i* and fractures 113*a-i*, the second set of wellbores 120*a-i* having vertical portions 121*a-i* and horizontal portions 122*a-i* and fractures 123*a-i*, the wellheads 11*a-i* and 12*a-i*, the gas injection equipment 20, and the separation equipment 30. The description of these aspects is not reproduced here.

The wellbore environment in FIG. 3 additionally includes a subterranean gas capture wellbores 130*a-x*. The subterranean gas capture wellbore(s) 130*a-x* is/are formed in the subterranean formation 102 for purposes of recovering injected produced gas 42 that would otherwise be lost into the subterranean formation 102 (e.g., into zone 105, and/or trapped under impermeable zone 106). The subterranean gas capture wellbore(s) 130*a-x* can be embodied as a single wellbore extending into zone 105; alternatively, the subterranean gas capture wellbore(s) 130*a-x* can be any number of wellbores, with "a-x" representing a range of any number of wellbores 130*a-x*. The subterranean gas capture wellbores 130*a-x* each has a vertical portion 131*a-x* and a horizontal portion 132*a-x*. While not drawn to scale, the subterranean gas capture wellbores 130*a-x* can extend to a depth of greater than 10,000 ft (3048 m) below the surface 101 of the Earth, at depths that are not as deep as wellbores 110*a-i* and wellbores 120*a-i*.

The subterranean gas capture wellbores 130*a-x* can be referred to as an unconventional wellbores because of the presence of the horizontal portions 132*a-x* of the subterranean gas capture wellbores 130*a-x*. Horizontal portions 132*a-x* of the subterranean gas capture wellbores 130*a-x* are formed in non-producing zone 105 of the subterranean formation 102, and forming the subterranean gas capture wellbores 130*a-x* in the non-producing zone 105 converts the non-producing zone 105 into a gas capture zone 105.

Figure 4A:
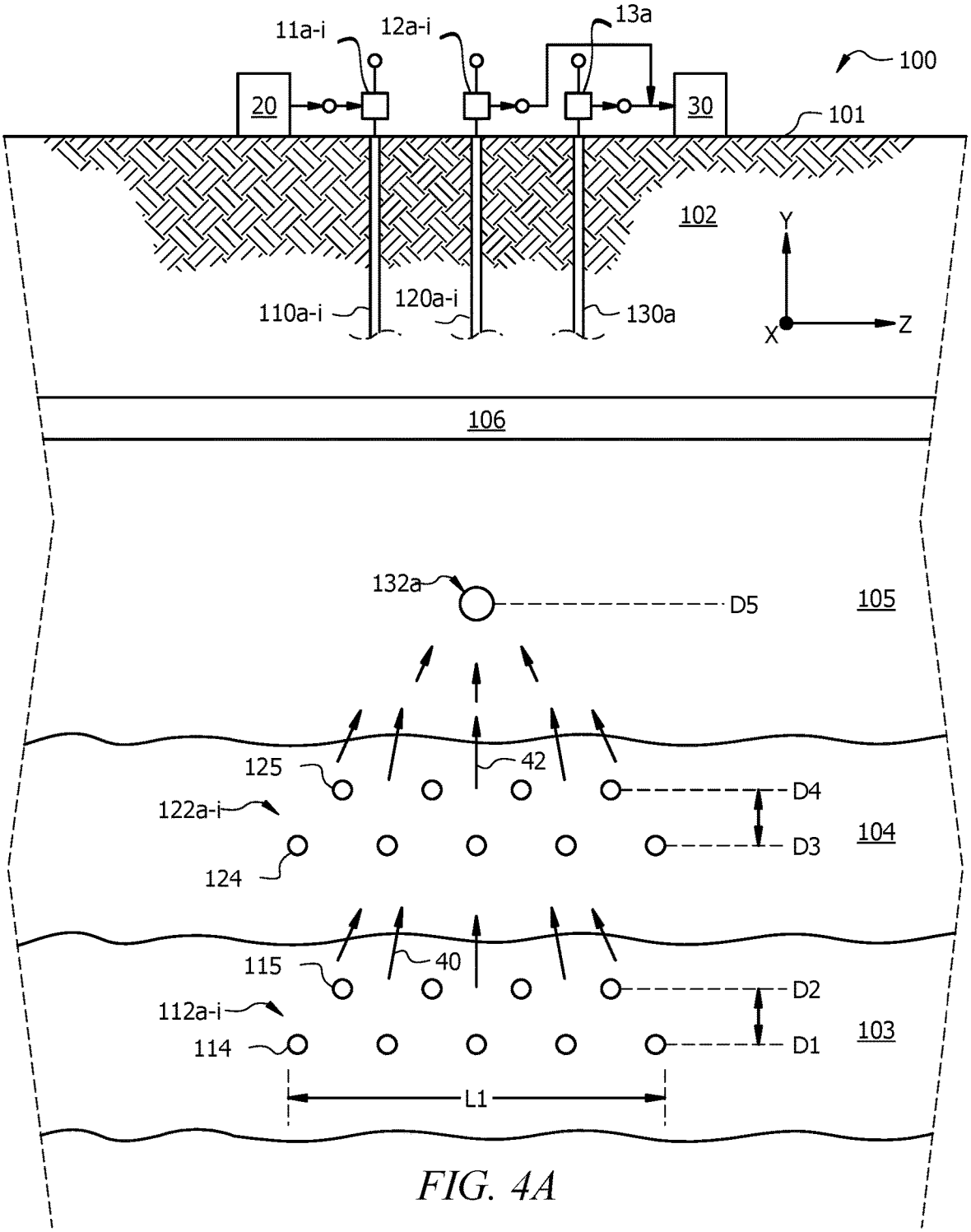
FIGS. 4A to 4D illustrate additional cross-sectional views of the wellbore environment of FIG. 3, viewing a Z-Y plane of the subterranean formation with the X-axis pointing into the page.
Figure 4B:
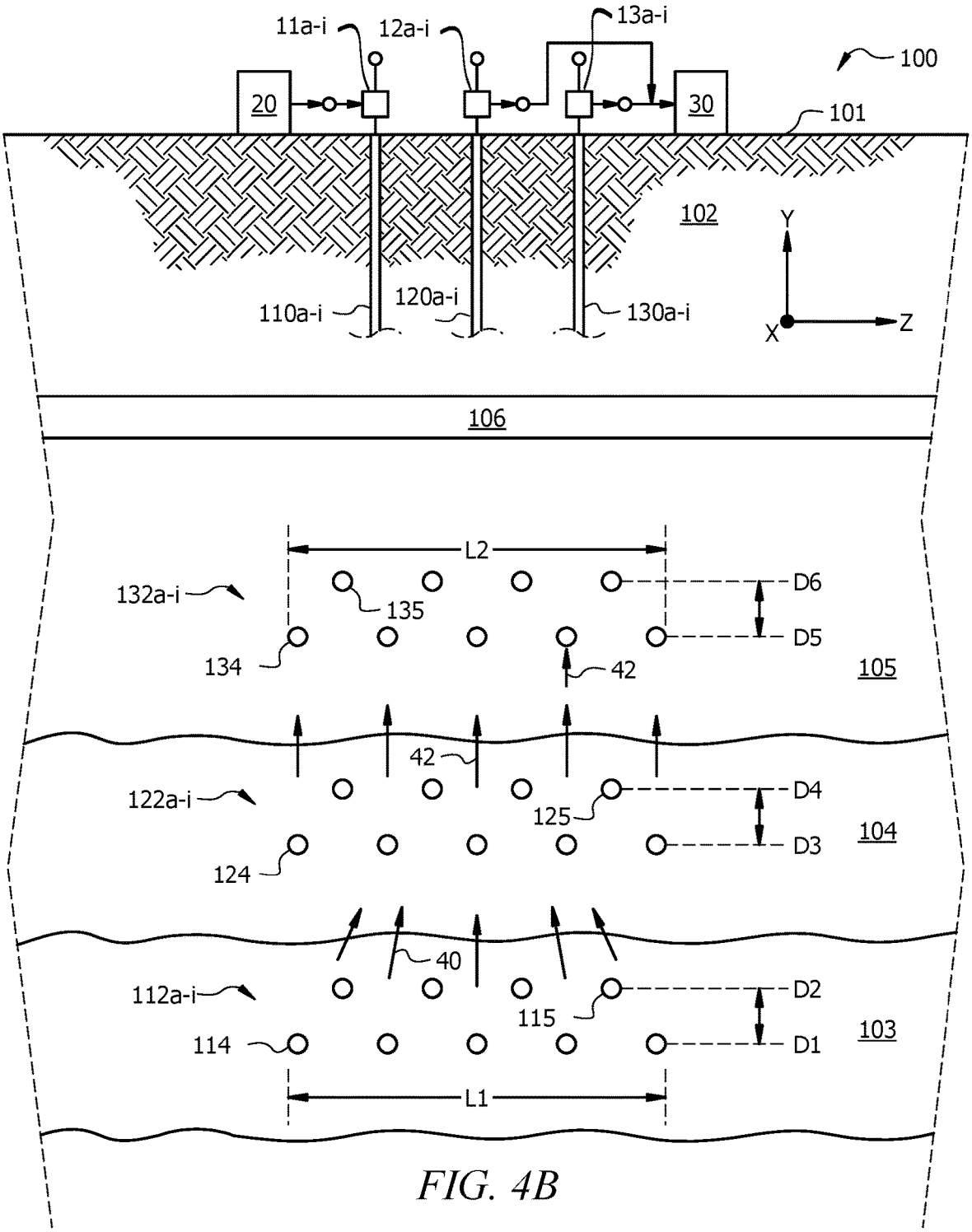

Each of the horizontal portions 132*a-x* can be fluidly coupled or otherwise fluidly connected to a corresponding vertical portion 131*a-x* of the subterranean gas capture wellbores 130*a-x*. In aspects, the horizontal portions 132*a-x* of the subterranean gas capture wellbores 130*a-x* can be laterally spaced from one another, vertically spaced from one another (stacked), or both laterally and vertically spaced from one another. An example of a single subterranean gas capture wellbore 130*a* is illustrated in FIG. 4A, and examples of arrangements of subterranean gas capture wellbores 132*a-x* for the subterranean gas capture wellbores 130*a-x* are illustrated in FIG. 4B (nine (9) wellbores 130*a-i*), FIG. 4C (twenty (2) wellbores 130*a-t*), and FIG. 4D (nine (9) wellbores 130*a-i*). The examples are described in more detail herein.

The horizontal portions 132*a-x* of the subterranean gas capture wellbores 130*a-x* are formed at a vertical depth below the surface 101 of the Earth that is less than the vertical depth below the surface 101 of the Earth at which the horizontal portion 122*a-i* of the second set of wellbores 120*a-i* are formed and the vertical depth below the surface 101 of the Earth at which the horizontal portions 112*a-i* of the first set of wellbores 110*a-i* are formed.

The horizontal portions 132*a-x* of the subterranean gas capture wellbores 130*a-x* can include fractures 133*a-x* that are formed in the gas capture zone 105 of the subterranean formation 102. The fractures 133*a-x* can be formed according to any technique for fracturing a formation for hydrocarbon production.

In aspects, the subterranean gas capture wellbores 130*a-x* and fractures 133*a-x* can be formed in a drilling stage when the first set of wellbores 110*a-i*, the second set of wellbores 120*a-i*, and the fractures 113*a-i* and 123*a-i* are formed (e.g., prior to secondary hydrocarbon recovery that occurs after fracking wellbores 110*a-i* and 120*a-i*). In alternative aspects, the subterranean gas capture wellbores 130*a-i* and fractures 133*a-i* can be formed after secondary hydrocarbon recovery and prior to gas enhanced hydrocarbon recovery.

The wellbore environment 100 in FIG. 3 illustrates that, during gas enhanced hydrocarbon recovery, produced gas 40 is injected into the first set of wellbores 110*a-i* (the lowest wellbores or lowest set of wellbores) and into the subterranean formation 102 via the horizontal portions 112*a-i* of the wellbores 110*a-i*. Presence of the fractures 113*a-i* that were previously made for production of hydrocarbons, in this case, aids in distributing the injected produced gas into the production zone 103 of the subterranean formation 102.

The injected produced gas 40 moves in many directions, including upward as indicated by the upward pointing arrows in FIG. 3. The injected produced gas 40 can rise upward through the subterranean formation 102 from the horizontal portions 112*a-i* of the wellbores 110*a-i* due to the lower density of the produced gas compared to the rock, minerals, water, brine, or other hydrocarbons that are contained in the subterranean formation 102. Some of the produced gas 40 has the effect of increasing hydrocarbon recovery, urging hydrocarbons in the producing zones 103 and 104 of the subterranean formation 102 toward the horizontal portions 122*a-i* of the second set of wellbores 120*a-i* that are stacked relative to the horizontal portions 112*a-i* of the first set of wellbores 110*a-i* (the first set of wellbores 110*a-i* being the injection wellbores in the gas enhanced recovery technique). A hydrocarbon-containing fluid 50 that includes some of the produced gas 40 can flow through the second set of wellbores 120*a-i* to the wellheads 12*a-i* at the surface 101 (and to the separation equipment 30).

FIG. 3 illustrates that some of the produced gas 42 is lost into zone 105 of the subterranean formation 102, at locations in the subterranean formation 102 that are above the wellbores 110*a-i* and 120*a-i*. However, the technical solution of the lost produced gas problem is the presence of the horizontal portions 132*a-x* of the subterranean gas capture wellbores 130*a-x* which are located in the subterranean formation 102 at one or more depths that are less than the depths of the wellbores 110*a-i* and wellbores 120*a-i*. Produced gas 40 can rise in the gas capture zone 105 of the subterranean formation 102 and be attracted to the fractures 133*a-x* near the horizontal portions 132*a-x* of the gas capture wellbores 130*a-x*, for example, urged via a pressure differential between the native pressure in the zone 105 in the subterranean formation 102 and the pressure in the gas capture wellbores 130*a-x*. Captured produced gas 44 flows into the horizontal portions 132*a-x* of the subterranean gas capture wellbores 130*a-x*, upward to the wellheads 13*a-x* at the surface 101 that are fluidly connected to the wellbores 130*a-x*, where the captured produced gas 44 can flow to the separation equipment 30 for recovery. In aspects, the production of the captured produced gas 44 from the gas capture wellbores 130*a-x* can occur concurrently with production of the hydrocarbon-containing fluid 50 from the second set of wellbores 120*a-i*. Alternatively, the production of captured produced gas 44 from the gas capture wellbores 130*a-x* can occur independently of any production of the hydrocarbon-containing fluid 50 from the second set of wellbores 120*a-i*.

In aspects, when capturing lost gas when the hydrocarbon-containing fluid 50 is being produced from the second set of wellbores 120*a-i*, the amount of lost produced gas 42 that is captured as captured produced gas 44 can be in a range of from 25 vol % to 50 vol % based on a total volume of the injected produced gas 40. In additional or alternative aspects, when capturing lost gas when no hydrocarbon-containing fluid 50 is being produced from the second set of wellbores 120*a-i*, the amount of lost produced gas 42 that is captured as captured produced gas 44 can be in a range of from 25 vol % to 75 vol % based on a total volume of the injected produced gas 40.

FIGS. 4A to 4D illustrate cross-sectional views of the wellbore environment 100 of FIG. 3, viewing a Z-Y plane of the subterranean formation 102 with the X-axis pointing into the page. It can be noticed that some vertical portions of the wellbores 110*a-i*, 120*a-i*, and 130*a-x* that are drawn in FIG. 3 are not drawn in FIGS. 4A to 4D, for clarity of viewing the horizontal portions 112*a-i*, 122*a-i*, and 132*a-x* of the wellbores 110*a-i*, 120*a-i*, and 130*a-x* via the Z-Y plane of the subterranean formation 102. Further, other arrangements of horizontal portions 132*a-x* are contemplated and not limited by the arrangements illustrated. Moreover, the horizontal portions 132*a-x* can be in a gas capture arrangement that is different than the arrangements of the horizontal portions 112*a-i*, horizontal portions 122*a-i*, or both horizontal portions 112*a-i* and horizontal portions 122*a-i*. Further, the arrangement of the gas capture wellbores can be influenced by 1) naturally occurring fractures coinciding with the wellbores 130*a-x* in the area promote gas recovery 2) low pressure, or depleted zones coinciding with the wellbores 130*a-x* that can promote gas capture, or 3) other geologic or rock/fluid characteristics which would promote capturing the lost injected gas 42.

FIGS. 4A to 4D illustrate that the subterranean formation 102 can include an injection wellbores including multiple horizontal portions extending into the subterranean formation 102, production wellbores including multiple horizontal portions extending into the subterranean formation 102 above the multiple horizontal portions of the injection wellbores, and at least one gas capture wellbore having a horizontal portion extending into the subterranean formation 102 above the multiple horizontal portions of the injection wellbores and above the multiple horizontal portions of the production wellbores.

FIG. 4A illustrates a single subterranean gas capture wellbore 130*a* connected to a single gas capture wellbore 13*a*. The subterranean gas capture wellbore 130*a* can include a single horizontal portion 132*a* in the gas capture zone 105 of the subterranean formation 102. The horizontal portion 132*a* is located at depth D5, which is less than any of the depths D1 to D4 of the horizontal portions 112*a-i* of wellbores 110*a-i* and horizontal portions 122*a-i* of wellbores 120*a-i*. In FIG. 4A, the horizontal portion 132*a* of the gas capture wellbore 130*a* is centered above (stacked above) the horizontal portions 122*a-i* of the second set of wellbores 120*a-i* (the production wellbores) and the horizontal portions 112*a-i* of the first set of wellbores 110*a-i* (the injection wellbore).

In FIG. 4A, horizontal portions 112*a-i* and the first set of wellbores 110*a-i* and horizontal portions 122*a-i* of the second set of wellbores 120*a-i* are formed at the same depths D1, D2, D3, and D4 and arrangement as described in FIG. 2. The description is thus not reproduced in the descriptions for FIG. 4A, or for FIGS. 4B to 4D.

The horizontal portions 122*a-i* of the wellbores 120*a-i* are stacked relative to the horizontal portions 112*a-i* of the wellbores 110*a-i*, and the horizontal portion 132*a* of the gas capture wellbore 130*a* is stacked relative to the horizontal portions 112*a-i* of the wellbores 110*a-i* and horizontal portions 122*a-i* of the wellbores 120*a-i*.

During gas enhanced hydrocarbon recovery, produced gas is injected into horizontal portions 112*a-i* of the wellbores 110*a-i*, the injected produced gas 40 rises upward such that a first portion flows into the horizontal portions 122*a-i* of the second set of wellbores 120*a-i* and a second portion of the injected produced gas 40 becomes lost produced gas 42 and does not flow into the second set of wellbores 120*a-i*. The lost produced gas 42 rises from the production zone 104 into the gas capture zone 105 of the subterranean formation 102. At least some of the lost produced gas 42 rises upward to the horizontal portion 132*a* of the subterranean gas capture wellbore 130*a*, where it is captured and produced as captured produced gas 44.

FIG. 4B illustrates nine (9) subterranean gas capture wellbores 130*a-i* with horizontal portions 132*a-i* in the gas capture zone 105 of the subterranean formation 102. The horizontal portions 132*a-i* are located at depths D5 and D6, which are less than any of the depths D1 to D4 of the horizontal portions 112*a-i* and 122*a-i* of the wellbores 110*a-i* and 120*a-i*. In FIG. 4B, the horizontal portions 132*a-i* of the gas capture wellbores 130*a-i* are stacked above the horizontal portions 122*a-i* of the second set of wellbores 120*a-i* (the production wellbores) and the horizontal portions 112*a-i* of the first set of wellbores 110*a-i* (the injection wellbores).

In FIG. 4B, the horizontal portions 112*a-i* of the first set of wellbores 110*a-i* have the same configuration discussed for FIG. 2, and the horizontal portions 122*a-i* of the second set of wellbores 120*a-i* have the same configuration discussed for FIG. 2.

The horizontal portions 132*a-i* of the gas capture wellbores 130*a-i* are formed such that a first set 134 of horizontal portions 132*a-i* is at depth D5 and a second set 135 of horizontal portions 132*a-i* is at a depth D6, where depth D5 is greater than depth D6. The first set 134 are horizontally equally-spaced relative to one another, and the second set 135 are horizontally equally-spaced relative to one another. The end-to-end length L2 of the horizontal portions 132*a-i* can be seen in the Z-direction of the view shown in FIG. 4B. In aspects, the length L1 of the horizontal portions 112*a-i* and 122*a-i* can be the same as the length L2 of the horizontal portions 132*a-i*; alternatively, the Z-direction spacing of the horizontal portions 132*a-i* and/or number of horizontal portions 132*a-i* can be greater such that L2 is greater than L1. In some aspects, having L2 greater than L1 can enhance capture of any lost produced gas 42 the migrates laterally in the subterranean formation 102 in the Z-direction in FIG. 4B while rising upward in the subterranean formation 102.

During gas enhanced hydrocarbon recovery, produced gas is injected into horizontal portions 112*a-i* of the wellbores 110*a-i*, the injected produced gas 40 rises upward such that a first portion flows into the horizontal portions 122*a-i* of the second set of wellbores 120*a-i* and a second portion of the injected produced gas 40 becomes lost produced gas 42 and does not flow into the second set of wellbores 120*a-i*. The lost produced gas 42 rises from the production zone 104 into the gas capture zone 105 of the subterranean formation 102. At least some of the lost produced gas 42 rises upward to the horizontal portions 132*a-i* of the subterranean gas capture wellbores 130*a-i*, where it is captured and produced as captured produced gas 44.

Figure 4C:
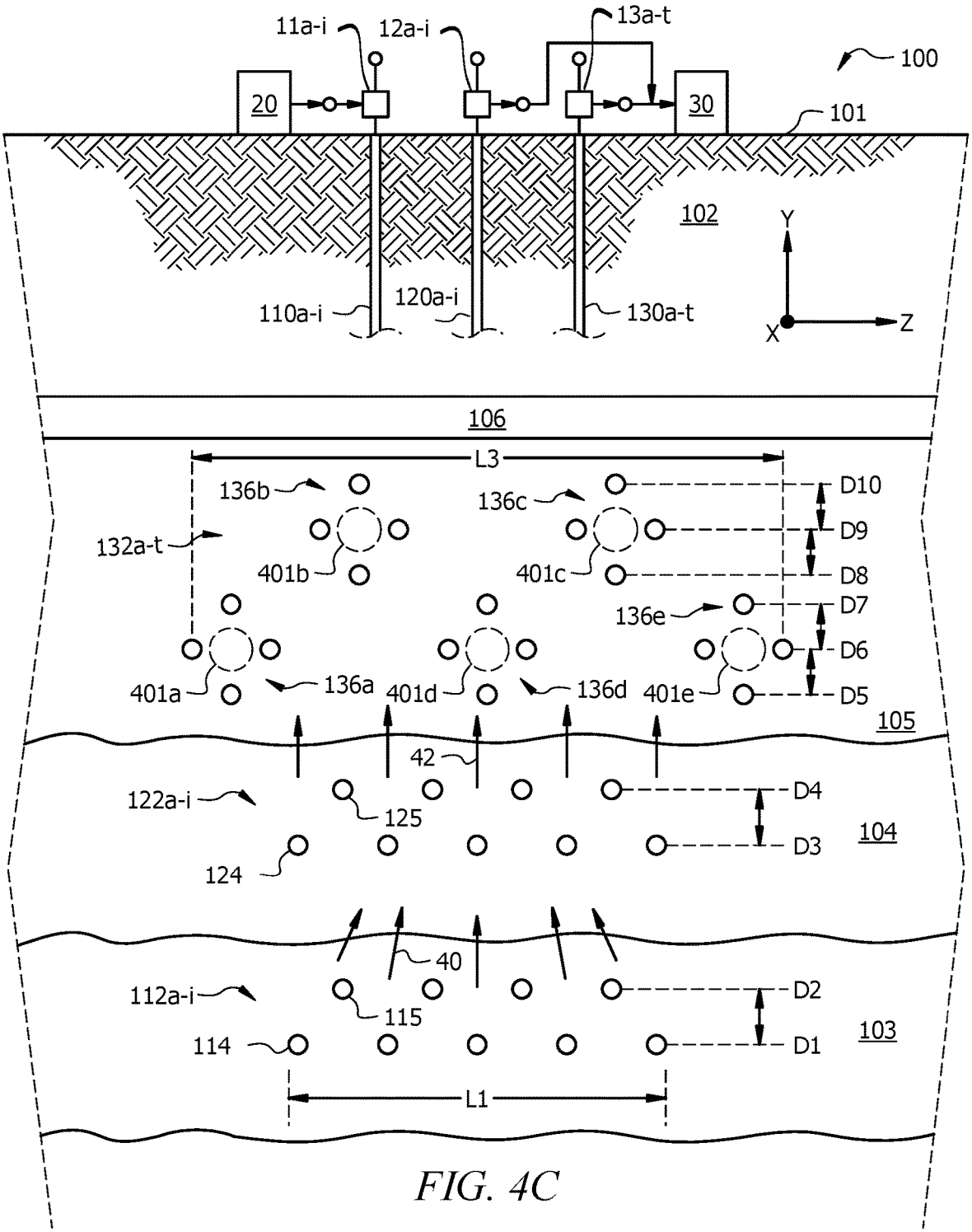

FIG. 4C illustrates subterranean gas capture wellbores 130*a-t* having horizontal portions 132*a-t* arranged in the gas capture zone 105 of the subterranean formation 102, where the horizontal portions 132*a-t* are in a different arrangement than the horizontal portions 132*a-i* in FIG. 4B. The horizontal portions 132*a-t* of the gas capture wellbores 130*a-t* in FIG. 4C can be arranged in sets 136*a*, 136*b*, 136*c*, 136*d*, and 136*e* of horizontal portions 132*a-t*. In aspects, each set of the sets 136*a*, 136*b*, 136*c*, 136*d*, and 136*e* of horizontal portions 132*a-t* forms a regular or irregular shape when viewed from a cross-section of the multiple horizontal portions 132*a-t* that is cut along diameters of the multiple horizontal portions 132*a-t*.

The horizontal portions 132*a-t* are located at depths D5, D6, D7, D8, D9, and D10, which are less than any of the depths D1, D2, D3, and D4 of the horizontal portions 112*a-i* and 122*a-i* of the wellbores 110*a-i* and 120*a-i*. In FIG. 4C, the horizontal portions 132*a-t* of the gas capture wellbores 130*a-t* are stacked above the horizontal portions 122*a-i* of the second set of wellbores 120*a-i* (the production wellbores) and the horizontal portions 112*a-i* of the first set of wellbores 110*a-i* (the injection wellbores). The horizontal portions 112*a-i* of the first set of wellbores 110*a-i* have the same configuration discussed for FIG. 2, and the horizontal portions 122*a-i* of the second set of wellbores 120*a-i* have the same configuration discussed for FIG. 2.

The horizontal portions 132*a-t* of the gas capture wellbores 130*a-t* are formed such that a first set 136*a*, fourth set 136*d*, and fifth set 136*e* are at depths D5, D6, and D7. The horizontal portions 132*a-t* of the gas capture wellbores 130*a-t* are also formed such that a second set 136*b* and a third set 136*c* are depth D8, D9, and D10. In aspects, depth D5 is greater than depth D6, depth D6 is greater than depth D7, depth D7 is greater than depth D8, depth D8 is greater than depth D9, and depth D9 is greater than depth D10.

The arrangement of each of the sets 136*a*, 136*b*, 136*c*, 136*d*, and 136*e* can resemble any regular or irregular shape from the view of the Z-Y plane in FIG. 4C. Examples of regular shapes can include a circle, oval, triangle, square, rectangle, pentagon, and greater-sided polygons. In FIG. 4C, each of the sets 136*a*, 136*b*, 136*c*, 136*d*, and 136*e* resemble a diamond shape. Arranging each set 136*a*, 136*b*, 136*c*, 136*d*, and 136*e* into a shape forms a micro-zone 401*a*, 401*b*, 401*c*, 401*d*, and 401*e* for attracting lost produced gas 42 to the horizontal portions 132*a-t* of the gas capture wellbores 130*a-t*.

The end-to-end length L3 of the horizontal portions 132*a-t* can be seen in the Z-direction of the view shown in FIG. 4C. In aspects, the length L1 of the horizontal portions 112*a-i* and 122*a-i* can be the same as the length L3 of the horizontal portions 132*a-t*; alternatively, the Z-direction spacing of the horizontal portions 132*a-t* and/or number of horizontal portions 132*a-t* can be greater such that L3 is greater than L1. In some aspects, having L3 greater than L1 can enhance capture of any lost produced gas 42 the migrates laterally in the subterranean formation 102 in the Z-direction in FIG. 4C while rising upward in the subterranean formation 102.

Figure 4D:
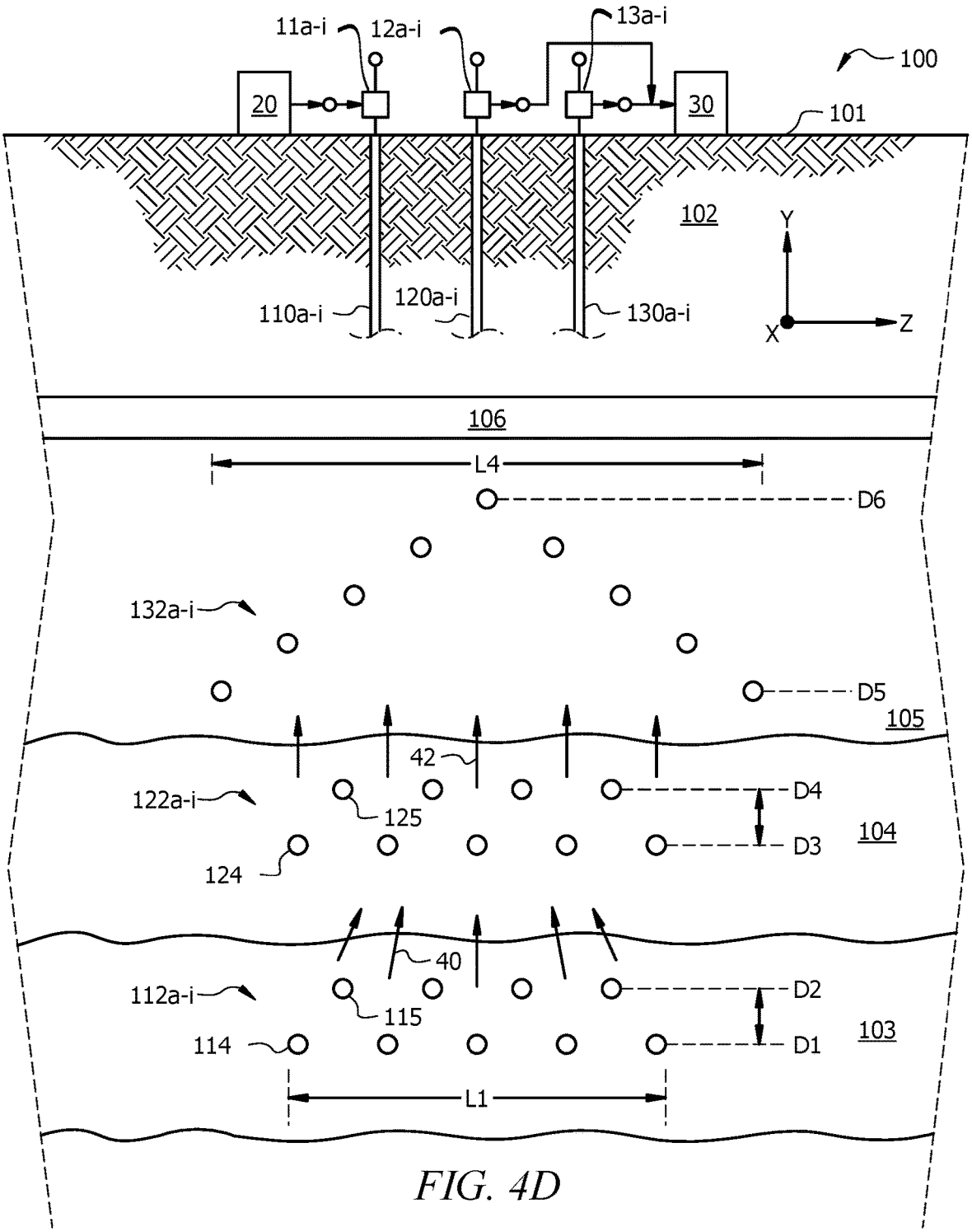

FIG. 4D illustrates subterranean gas capture wellbores 130*a-i* having horizontal portions 132*a-i* arranged in the gas capture zone 105 of the subterranean formation 102, where the horizontal portions 132*a-i* are in a different arrangement than in FIG. 4B and FIG. 4C. Generally, the arrangement can take any form, geometrically or otherwise, at any density (distance between wellbores is equal or variable among a collection or group of adjacent wellbore), or spacing (equal or variable among a collection or group of adjacent wellbore) within zone 105 and relative to zones 103 and 104. Particularly, the horizontal portions 132*a-i* of the subterranean gas capture wellbores 130*a-i* are arranged in a dome-like shape when viewed from a cross-section of the multiple horizontal portions 132*a-i* that is cut along the diameters of the multiple horizontal portions 132*a-i*.

The horizontal portions 132*a-i* are located at various depths in a range from depth D5 to depth D6, which are less than any of the depths D1, D2, D3, and D4 of the horizontal portions 112*a-i* and 122*a-i* of the wellbores 110*a-i* and 120*a-i*. In FIG. 4D, the horizontal portions 132*a-i* of the gas capture wellbores 130*a-i* are stacked above the horizontal portions 122*a-i* of the second set of wellbores 120*a-i* (the production wellbores) and the horizontal portions 112*a-i* of the first set of wellbores 110*a-i* (the injection wellbores).

The horizontal portions 112*a-i* of the first set of wellbores 110*a-i* have the same configuration discussed for FIG. 2, and the horizontal portions 122*a-i* of the second set of wellbores 120*a-i* have the same configuration discussed for FIG. 2.

The horizontal portions 132*a-i* of the gas capture wellbores 130*a-i* are formed such that a dome-like pattern is made. Similar to how lost produced gas 42 can be trapped under a dome-like formation of impermeable zone 106, the dome-like pattern of the horizontal portions 132*a-i* can trap the lost produced gas 42 into a migration path that leads to the horizontal portions 132*a-i* for capture of to produce the captured produced gas 44.

The end-to-end length L4 of the horizontal portions 132*a-i* can be seen in the Z-direction of the view shown in FIG. 4D. In aspects, the length L1 of the horizontal portions 112*a-i* and 122*a-i* can be the same as the length L4 of the horizontal portions 132*a-i*; alternatively, the Z-direction spacing of the horizontal portions 132*a-i* and/or number of horizontal portions 132*a-i* can be greater such that L4 is greater than L1. In some aspects, having L4 greater than L1 can enhance capture of any lost produced gas 42 the migrates laterally in the subterranean formation 102 in the Z-direction in FIG. 4C while rising upward in the subterranean formation 102.

During gas enhanced hydrocarbon recovery, produced gas is injected into horizontal portions 112*a-i* of the wellbores 110*a-i*, the injected produced gas 40 rises upward such that a first portion flows into the horizontal portions 122*a-i* of the second set of wellbores 120*a-i* and a second portion of the injected produced gas 40 becomes lost produced gas 42 and does not flow into the second set of wellbores 120*a-i*. The lost produced gas 42 rises from the production zone 104 into the gas capture zone 105 of the subterranean formation 102. At least some of the lost produced gas 42 rises upward to the dome-like pattern of the horizontal portions 132*a-i* of the gas capture wellbores 130*a-i*, where it is captured and produced as captured produced gas 44.

Processes

In some aspects, the techniques described herein relate to a first process that can include injecting a produced gas into a subterranean formation via a horizontal portion of a first wellbore that extends into the subterranean formation; recovering a hydrocarbon-containing fluid containing a first portion of the injected produced gas from a horizontal portion of a second wellbore that extends into the subterranean formation, wherein a depth of the horizontal portion of the first wellbore in the subterranean formation is greater than a depth of the horizontal portion of the second wellbore in the subterranean formation; and recovering a second portion of the injected produced gas from a gas capture wellbore that extends into the subterranean formation, wherein the gas capture wellbore has a horizontal portion having a gas capture depth that is less than a depth of the horizontal portion of the second wellbore.

In some aspects, the first process can include, prior to injecting, producing hydrocarbons from the first wellbore and the second wellbore; and prior to injecting, stopping production of the hydrocarbons from the first wellbore. In some aspects, the first process can include, prior to injecting and after stopping, disconnecting the first wellbore from a separation equipment; and prior to injecting, connecting the first wellbore to a gas injection equipment. In some aspects, the first process can include, prior to producing, fracking the subterranean formation via the first wellbore and the second wellbore. In some aspects, the first process can include, prior to recovering, fracking the subterranean formation via the subterranean gas capture wellbore. In some aspects, the first process can include, operating the subterranean gas capture wellbore such that a pressure in the horizontal portion of the subterranean gas capture wellbore is less than a pressure in the subterranean formation where the horizontal portion of the subterranean gas capture wellbore is located. In some aspects, the first process can include recovering the produced gas from hydrocarbon-containing fluid to be used in the injecting. In some aspects, the first process can include converting a non-producing zone of the subterranean formation into a gas capture zone by forming the gas capture wellbore in the non-producing zone. In aspects of the first process, the horizontal portions of the gas capture wellbore can have any number and configuration described herein.

In some aspects, the techniques described herein relate to a second process that can include converting a non-producing zone of a subterranean formation into a gas capture zone by forming a gas capture wellbore in the non-producing zone, wherein the gas capture wellbore has a horizontal portion that is stacked above a horizontal portion of a production wellbore that extends into a producing zone of the subterranean formation and stacked above a horizontal portion of an injection wellbore that extends into or below the producing zone of the subterranean formation. In aspects of the second process, converting is performed after secondary hydrocarbon recovery and prior to gas enhanced hydrocarbon recovery from the subterranean formation. In aspects, the second process can further include forming the gas capture wellbore in the non-producing zone of the subterranean formation. In one aspects, forming is performed prior to secondary hydrocarbon recovery from the subterranean formation, while in an alternative aspect, forming is performed after secondary hydrocarbon recovery from the subterranean formation. In aspects, the second process can include any one or any combination of the steps and features of the first process.

Additional Description

Processes and wellbore arrangements in a subterranean formation have been described. The present application is also directed to the subject-matter described in the following numbered paragraphs (referred to as "Aspect" or "Aspects"):

Aspect 1. A process comprising: injecting a produced gas into a subterranean formation via a horizontal portion of a first wellbore that extends into the subterranean formation; recovering a hydrocarbon-containing fluid containing a first portion of the injected produced gas from a horizontal portion of a second wellbore that extends into the subterranean formation, wherein a depth of the horizontal portion of the first wellbore in the subterranean formation is greater than a depth of the horizontal portion of the second wellbore in the subterranean formation; and recovering a second portion of the injected produced gas from a gas capture wellbore that extends into the subterranean formation, wherein the gas capture wellbore has a horizontal portion having a gas capture depth that is less than a depth of the horizontal portion of the second wellbore.

Aspect 2. The process of Aspect 1, further comprising: prior to injecting, producing hydrocarbons from the first wellbore and the second wellbore; and prior to injecting, stopping production of the hydrocarbons from the first wellbore.

Aspect 3. The process of Aspect 1 or 2, further comprising: prior to injecting and after stopping, disconnecting the first wellbore from a separation equipment; and prior to injecting, connecting the first wellbore to a gas injection equipment.

Aspect 4. The process of Aspect 2, further comprising: prior to producing, fracking the subterranean formation via the first wellbore and the second wellbore.

Aspect 5. The process of any one of Aspects 1 to 4, further comprising: prior to recovering, fracking the subterranean formation via the subterranean gas capture wellbore.

Aspect 6. The process of any one of Aspects 1 to 5, further comprising: operating the subterranean gas capture wellbore such that a pressure in the horizontal portion of the subterranean gas capture wellbore is less than a pressure in the subterranean formation where the horizontal portion of the subterranean gas capture wellbore is located.

Aspect 7. The process of any one of Aspects 1 to 6, wherein the produced gas comprises methane, ethane, propane, or combinations thereof.

Aspect 8. The process of any one of Aspects 1 to 7, further comprising: recovering the produced gas from hydrocarbon-containing fluid to be used in the injecting.

Aspect 9. The process of any one of Aspects 1 to 8, wherein the horizontal portion of the subterranean gas capture wellbore is stacked relative to the horizontal portion of the first wellbore and relative to the horizontal portion of the second wellbore.

Aspect 10. The process of any one of Aspects 1 to 9, wherein the horizontal portion of the subterranean gas capture wellbore is one of multiple horizontal portions of the subterranean gas capture wellbore.

Aspect 11. The process of Aspect 10, wherein the multiple horizontal portions of the subterranean gas capture wellbore are arranged in sets of horizontal portions, wherein each set of the sets of horizontal portions forms a regular or irregular shape when viewed from a cross-section of the multiple horizontal portions that is cut along diameters of the multiple horizontal portions.

Aspect 12. The process of Aspect 10, wherein the multiple horizontal portions of the subterranean gas capture wellbore are arranged in a dome-like shape when viewed from a cross-section of the multiple horizontal portions that is cut along diameters of the multiple horizontal portions.

Aspect 13. The process of any one of Aspects 1 to 12, further comprising: converting a non-producing zone of the subterranean formation into a gas capture zone by forming the gas capture wellbore in the non-producing zone.

Aspect 14. A process comprising: converting a non-producing zone of a subterranean formation into a gas capture zone by forming a gas capture wellbore in the non-producing zone, wherein the gas capture wellbore has a horizontal portion that is stacked above a horizontal portion of a production wellbore that extends into a producing zone of the subterranean formation and stacked above a horizontal portion of an injection wellbore that extends into or below the producing zone of the subterranean formation.

Aspect 15. The process of Aspect 14, wherein converting is performed after secondary hydrocarbon recovery and prior to gas enhanced hydrocarbon recovery from the subterranean formation.

Aspect 16. The process of Aspect 14 or 15, further comprising: forming the gas capture wellbore in the non-producing zone of the subterranean formation.

Aspect 17. The process of Aspect 16, wherein forming is performed prior to secondary hydrocarbon recovery from the subterranean formation.

Aspect 18. The process of Aspect 16, wherein forming is performed after secondary hydrocarbon recovery from the subterranean formation.

Aspect 19. A subterranean formation comprising: an injection wellbore comprising multiple horizontal portions extending into the subterranean formation; a production wellbore comprising multiple horizontal portions extending into the subterranean formation above the multiple horizontal portions of the injection wellbore; and a gas capture wellbore comprising one or more horizontal portions extending into the subterranean formation above the multiple horizontal portions of the injection wellbore and above the multiple horizontal portions of the production wellbore.

Aspect 20. The subterranean formation of Aspect 19, wherein i) the one or more horizontal portions of the gas capture wellbore are arranged in sets of horizontal portions, wherein each set of the sets of horizontal portions forms a regular or irregular shape when viewed from a cross-section of the multiple horizontal portions that is cut along diameters of the multiple horizontal portions; or ii) the one or more horizontal portions of the subterranean gas capture wellbore are arranged in a dome-like shape when viewed from a cross-section of the multiple horizontal portions that is cut along the diameters of the multiple horizontal portions.

Although the present disclosure and its advantages have been described in detail, it should be understood that various changes, substitutions, and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A process comprising:

injecting a produced gas into a subterranean formation via a horizontal portion of a first wellbore that extends into the subterranean formation, wherein the produced gas comprises methane, ethane, propane, or combinations thereof;

recovering a hydrocarbon-containing fluid containing a first portion of the injected produced gas from a horizontal portion of a second wellbore that extends into the subterranean formation, wherein a depth of the horizontal portion of the first wellbore in the subterranean formation is greater than a depth of the horizontal portion of the second wellbore in the subterranean formation; and recovering a second portion of the injected produced gas from a gas capture wellbore that extends into a gas capture zone of the subterranean formation, wherein the gas capture wellbore has a horizontal portion having a gas capture depth that is less than a depth of the horizontal portion of the second wellbore.

2. The process of claim 1, further comprising:

prior to injecting, producing hydrocarbons from the first wellbore and the second wellbore; and prior to injecting, stopping production of the hydrocarbons from the first wellbore.

3. The process of claim 2, further comprising:

prior to injecting and after stopping, disconnecting the first wellbore from a separation equipment; and prior to injecting, connecting the first wellbore to a gas injection equipment.

4. The process of claim 2, further comprising:

prior to producing, fracking the subterranean formation via the first wellbore and the second wellbore.

5. The process of claim 1, further comprising:

prior to recovering, fracking the subterranean formation via the gas capture wellbore.

6. The process of claim 1, further comprising:

operating the gas capture wellbore such that a pressure in the horizontal portion of the gas capture wellbore is less than a pressure in the subterranean formation where the horizontal portion of the gas capture wellbore is located.

7. The process of claim 1, further comprising:

recovering the produced gas from hydrocarbon-containing fluid to be used in the injecting.

8. The process of claim 1, wherein the horizontal portion of the gas capture wellbore is stacked relative to the horizontal portion of the first wellbore and relative to the horizontal portion of the second wellbore.

9. The process of claim 8, wherein the horizontal portion of the gas capture wellbore is one of multiple horizontal portions of the gas capture wellbore.

10. The process of claim 9, wherein the multiple horizontal portions of the gas capture wellbore are arranged in sets of horizontal portions, wherein each set of the sets of horizontal portions forms a regular or irregular shape when viewed from a cross-section of the multiple horizontal portions that is cut along diameters of the multiple horizontal portions.

11. The process of claim 9, wherein the multiple horizontal portions of the gas capture wellbore are arranged in a dome-like shape when viewed from a cross-section of the multiple horizontal portions that is cut along diameters of the multiple horizontal portions.

12. The process of claim 1, further comprising:

converting a non-producing zone of the subterranean formation into a gas capture zone by forming the gas capture wellbore in the non-producing zone.

13. The process of claim 1, wherein the gas capture zone i) does not contain hydrocarbons, or ii) contains hydrocarbons that are not recoverable through primary, secondary, and enhanced hydrocarbon recovery techniques.

14. A process comprising:

converting a non-producing zone of a subterranean formation into a gas capture zone by forming a gas capture wellbore in the non-producing zone, wherein the gas capture wellbore has a horizontal portion that is stacked above a horizontal portion of a production wellbore that extends into a producing zone of the subterranean formation and stacked above a horizontal portion of an injection wellbore that extends into or below the producing zone of the subterranean formation, wherein the gas capture zone i) dose not contain hydrocarbons, or ii) contains hydrocarbons that re not recoverable through primary, secondary, and enhanced hydrocarbon recovery techniques.

15. The process of claim 14, wherein converting is performed after secondary hydrocarbon recovery and prior to gas enhanced hydrocarbon recovery from the subterranean formation.

16. The process of claim 14, further comprising:

forming the gas capture wellbore in the non-producing zone of the subterranean formation.

17. The process of claim 16, wherein forming is performed prior to secondary hydrocarbon recovery from the subterranean formation.

18. The process of claim 16, wherein forming is performed after secondary hydrocarbon recovery from the subterranean formation.

19. A subterranean formation comprising:

an injection wellbore comprising multiple horizontal portions extending into the subterranean formation;

a production wellbore comprising multiple horizontal portions extending into the subterranean formation above the multiple horizontal portions of the injection wellbore, wherein the production wellbore is formed in a producing zone of the subterranean formation; and a gas capture wellbore comprising one or more horizontal portions extending into the subterranean formation above the multiple horizontal portions of the injection wellbore and above the multiple horizontal portions of the production wellbore, wherein the gas capture wellbore is formed in a gas capture zone of the subterranean formation, wherein the gas capture zone i) does not contain hydrocarbons, or ii) contains hydrocarbons that are not recoverable through primary, secondary, and enhanced hydrocarbon recovery techniques.

20. The subterranean formation of claim 19, wherein i) the one or more horizontal portions of the gas capture wellbore are arranged in sets of horizontal portions, wherein each set of the sets of horizontal portions forms an irregular shape when viewed from a cross-section of the multiple horizontal portions that is cut along diameters of the multiple horizontal portions; or ii) the one or more horizontal portions of the gas capture wellbore are arranged in a dome-like shape when viewed from a cross-section of the multiple horizontal portions that is cut along the diameters of the multiple horizontal portions.

* * * * *